US006203450B1

(12) United States Patent
Bradley et al.

(10) Patent No.: US 6,203,450 B1
(45) Date of Patent: Mar. 20, 2001

(54) GOLF BALL HAVING A CORE WHICH INCLUDES POLYURETHANE RUBBER

(75) Inventors: Wayne R. Bradley, Dyer; Frank M. Simonutti, Jackson, both of TN (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/417,446

(22) Filed: Oct. 13, 1999

Related U.S. Application Data

(63) Continuation-in-part of application No. 09/299,299, filed on Apr. 26, 1999, now abandoned.

(51) Int. Cl.[7] ..... A63B 31/00
(52) U.S. Cl. ..... 473/351; 525/193
(58) Field of Search ..... 473/351, 371, 473/367, 368, 372, 377; 525/193

(56) References Cited

U.S. PATENT DOCUMENTS

| | | | | |
|---|---|---|---|---|
| 3,979,126 | * | 9/1976 | Dusbiber | 473/373 |
| 5,508,350 | * | 4/1996 | Cardorniga et al. | 525/193 |
| 5,971,870 | * | 10/1999 | Sullivan et al. | 473/373 |
| 6,123,628 | * | 9/2000 | Ichikawa et al. | 473/371 |

* cited by examiner

*Primary Examiner*—Jeanette Chapman
*Assistant Examiner*—Raeann Gordon

(57) ABSTRACT

A golf ball includes a solid core which includes a blend of polybutadiene and polyurethane rubber. The rubber component of the core consists of 70 to 95% by weight of a high cis content polybutadiene rubber and 5 to 30% by weight of polyurethane rubber. The core also includes an acrylate of a zinc salt and an organic peroxide initiator.

11 Claims, 5 Drawing Sheets

GOLF BALL HAVING A CORE WHICH INCLUDES POLYURETHANE RUBBER

RELATED APPLICATION

This application is a continuation-in-part of co-pending U.S. patent application entitled "Golf Ball Core Utilizing Polyurethane Rubber", Ser. No. 09/299,299, filed Apr. 26, 1999.

BACKGROUND OF THE INVENTION

This invention relates to golf balls, and more particularly, to a golf ball having a core which includes polyurethane rubber.

Golf balls which are currently available fall into two general categories—balls which include a balata cover and balls which include a more durable, cut-resistant cover. Balata covers are made from natural balata, synthetic balata, or a blend of natural and synthetic balata. Natural rubber or other elastomers may also be included. Synthetic balata is trans polyisoprene and is commonly sold under the designation TP-301 available from Kuraray Isoprene Company Ltd.

Balata has been used as a cover for golf balls due to the excellent spin/playability properties and flight performance properties. However, balata is an expensive material, and processing balata golf balls is both time consuming and expensive.

Most cut-resistant covers utilize Surlyn ionomers, which are ionic copolymers available from E. I. du Pont de Nemours & Co. Surlyn ionomers are copolymers of olefin, typically ethylene, and an alpha-beta ethylenically unsaturated carboxylic acid, such as methacrylic acid. Neutralization of a number of the acid groups is effected with metal ions, such as sodium, zinc, lithium, and magnesium.

DuPont's U.S. Pat. No. 3,264,272 describes procedures for manufacturing ionic copolymers. Ionic copolymers manufactured in accordance with U.S. Pat. No. 3,264,272 may have a flexural modulus of from about 14,000 to about 100,000 psi as measured in accordance with ASTM method D-790.

DuPont's U.S. Pat. No. 4,690,981 describes ionic copolymers which include a softening comonomer. Ionic copolymers produced in accordance with U.S. Pat. No. 4,690,981 are considered "soft" ionic copolymers and have a flexural modulus of about 2800 to about 8500 psi. The disclosures of U.S. Pat. Nos. 3,264,272 and 4,690,981 are incorporated herein by reference.

Other cut-resistant materials which can be used in golf ball covers are ionic copolymers or ionomers available from Exxon under the name Iotek, which are similar to Surlyn ionomers except that acrylic acid is used rather than methacrylic acid.

Recently, ionomeric blends containing V.L.M.I. (Very Low Modulus Ionomers) have been used for golf ball covers. The addition of V.L.M.I. improves playability properties, but sacrifices coefficient of restitution as a function of initial velocity (C.O.R./Initial Velocity) and distance properties. Blends of ionomers containing V.L.M.I. are illustrated in U.S. Pat. Nos. 4,884,814 and 5,120,791.

High acid ionomers are ionomers having an acid content of 18% by weight or higher of an ethylenically unsaturated carboxylic acid. Standard grade ionomers are ionomers having an acid content of 15% by weight or lower of an ethylenically unsaturated carboxylic acid. Examples of high acid ionomers are Surlyns 8220 and 8140, which contain 20% and 19% by weight of an ethylenically unsaturated carboxylic acid, respectively.

Several patents describe using high acid ionomers to form golf ball covers. For example, U.S. Pat. No. 5,222,739 to Sumitomo Rubber Industries discloses a cover composition which contains an olefin and 20–30% of an ethylenically unsaturated carboxylic acid which has 15 to 30% of its carboxylic acid groups neutralized with monovalent or divalent metal ions. U.S. Pat. No. 5,298,572 to DuPont describes a composition formed from an ionomer or a blend of ionomers. The ionomer contains 16–25% by weight of an ethylenically unsaturated carboxylic acid which is neutralized with lithium, zinc and sodium ions.

Thermoplastic and castable polyurethane materials have been used in golf ball construction (primarily in golf ball covers) for many years, with varying levels of success.

Thermoplastic polyurethanes are produced through the reaction of bifunctional isocyanates, chain extenders and long chain polyols. To produce thermoplastic properties, it is necessary for the molecules to be linear. The hardness of the polymer can be adjusted based upon the ratio of hard/soft segments produced in the reaction. Thermoplastic polyurethanes have been evaluated as covers for golf balls, with no significant success. Thermoplastic polyurethanes generally do not have the resilience properties required for a premium sold core golf ball, and the temperature required to melt the thermoplastic polyurethanes make them unsuitable for use as covers on thread wound golf balls. Recently, there has been some success in utilizing thermoplastic polyurethanes as mantle layers in multi-layer golf ball covers.

Castable polyurethanes are made by reacting essentially equimolar amounts of diisocyanates with linear, long chain, non-crystalline polyesters or polyethers. This results in the production of a soft, high molecular weight mass with essentially no crosslinking. To solidify this material, chain extenders such as short chain diols (e.g., 1,4-butane diol) or aromatic diamines (e.g., methylene-bis-orthochloro aniline (MOCA)) are utilized. This results in creation of linear segments, which are rigid in comparison to the initial mass described above. Castable polyurethanes have been used in the production of wound golf balls for a number of years, as described in U.S. Pat. Nos. 4,123,061 and 5,334,673. However, this method of production (as descried in European Patent Application 0 578 466 A) is time consuming, and inefficient.

The vast majority of golf balls currently produced are two-piece golf balls, consisting of a solid core and a Surlyn (ionomer) cover. Generally, Surlyn covered golf balls have exceptional durability properties, but are considered hard compared to a wound ball construction, and are not preferred by the better player.

In recent years, new ionomers have been developed to result in softer feel and playability properties, but at a significant sacrifice in initial velocity and resilience properties. It is also important to note that if a very soft ionomer cover is used to lessen the compression of (soften) the golf ball, cut resistance properties also become poor.

More recently, golf balls have been introduced which utilize multi-layer covers, where a soft mantle or cover layer is used to improve the playability properties (feel—as measured by PGA compression) of the golf ball. This has been somewhat successful, but the feel (compression) of the ball can only be softened to a certain point before significant losses in resilience properties are observed. Generally, the mantle and cover layers of multi-layer golf balls are made using ionomers, thermoplastic polyester elastomers, polyether block co-polymers, and other thermoplastic materials.

The feel of a golf ball can also be improved by adjusting the composition of the solid core to produce a lower compression. Generally, a solid golf ball core is made utilizing primarily polybutadiene rubber, or a blend of polybutadiene rubber with a small amount of natural rubber, polyisoprene rubber, or both. The golf ball core is "cured" utilizing a zinc diacrylate/peroxide cure system. As the core formulation is adjusted to reduce core compression, resilience properties of the core decrease, and can decrease to a level where resilience properties are low, and unsuitable for use in a premium golf ball.

SUMMARY OF THE INVENTION

The invention consists of a golf ball formed using one or more cover layers and a solid core, where the core consists of a blend of polybutadiene and a polyurethane rubber (also known as "Millable Polyurethane"). This form of polyurethane is produced by reacting a polyol with a stoichiometric deficiency of isocyanate, which allows the material to be vulcanized, forming crosslinks between the polymer chains. The primary benefit of this form of polyurethane is that it lends itself to processing techniques common to rubber processing. The core may be cured by a method similar to the method used to cure conventional core formulations, i.e. a zinc diacrylate/peroxide cure system. The core formulations of the invention provide significant reduction in core compression, while retaining acceptable initial velocity and resilience properties which are required for a premium performance golf ball.

DESCRIPTION OF THE DRAWING

The invention will be explained in conjunction with an illustrative embodiment shown in the accompanying drawing, in which.

DESCRIPTION OF THE SPECIFIC EMBODIMENTS

Figure 1:
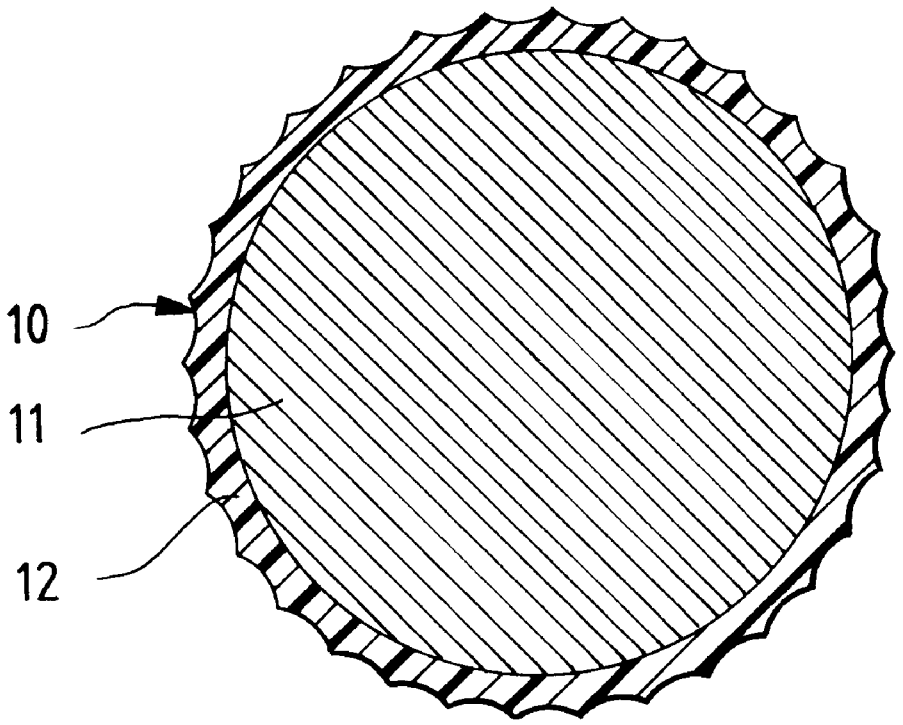
FIG. 1 is a cross sectional illustration of a golf ball which is formed in accordance with the invention.

FIG. 1 illustrates a golf ball 10 which includes a solid core 11 and a cover 12. If desired, the cover 12 can include an inner cover layer or mantle and an outer cover layer. The core 11 is molded from a compound comprising:

a) 100 phr rubber, the rubber component comprising from 70 to 95% by weight of a high cis content polybutadiene and from 5 to 30% of a polyurethane rubber (also referred to as Millable Polyurethane). The polyurethane rubber can be a polyether based polyurethane rubber, a polyester based polyurethane rubber, or a mixture of polyether and polyester based polyurethane rubbers.

b) 15 to 40 phr of a crosslinking agent, preferably an acrylate of a zinc salt, most preferably zinc diacrylate.

c) 0.5 to 5 phr of a crosslinking initiator, preferably an organic peroxide, most preferably dicumyl peroxide;

d) 0 to 10 phr of a metal oxide activator, preferably zinc oxide.

e) 0 to 1 phr of a titanate coupling agent such as monoalkoxy titanate and neoalkoxy titanate;

f) standard fillers, colorants, and/or other ingredients which are conventionally included in golf ball cores.

As used herein "phr" means "parts per hundred parts by weight of rubber."

Golf balls made using this core yield significantly improved playability properties (feel—as measured by compression) with acceptable initial velocity/resilience properties.

Materials suitable for use as the polyurethane rubber (Millable Polyurethane) are available from Uniroyal, under the trade name Adiprene, and from TSE Industries, under the trade name Millithane.

EXAMPLES

Golf ball cores were made in accordance with Table 1.

TABLE 1

Polybutadiene/Polyurethane Rubber Core Compound Evaluations

| | Examples | | | | | | |
|---|---|---|---|---|---|---|---|
| Material | C-1 | 1 | 2 | 3 | 4 | 5 | 6 |
| BR 1207 | 100 | 95 | 90 | 85 | 80 | 75 | 50 |
| Millithane E-34 | 0 | 5 | 10 | 15 | 20 | 25 | 50 |
| Adiprene CM | 0 | 0 | 0 | 0 | 0 | 0 | 0 |
| SR 416D | 23.5 | 23.5 | 23.5 | 23.5 | 23.5 | 23.5 | 23.5 |
| Zinc Oxide | 5 | 5 | 5 | 5 | 5 | 5 | 5 |
| Barytes | 21 | 21 | 21 | 21 | 21 | 21 | 21 |
| EF(DCP)-70 | 1.56 | 1.56 | 1.56 | 1.56 | 1.56 | 1.56 | 1.56 |
| Wingstay L-HLS | 0.2 | 0.2 | 0.2 | 0.2 | 0.2 | 0.2 | 0.2 |
| | Core Physical Properties | | | | | | |
| Size | 1.5052 | 1.5061 | 1.5036 | 1.5069 | 1.5064 | 1.5041 | 1.5023 |
| PGA Compression | 64.7 | 57 | 56.2 | 51.5 | 38.8 | 40.2 | 15.7 |
| Weight | 34.59 | 34.61 | 34.74 | 35.05 | 34.73 | 35.1 | 35.85 |
| COR (100 ft/s) | 0.817 | 0.812 | 0.8 | 0.791 | 0.782 | 0.771 | 0.71 |
| COR (125 ft/s) | 0.779 | 0.771 | 0.765 | 0.75 | 0.739 | 0.729 | 0.665 |

TABLE 1-continued

| Polybutadiene/Polyurethane Rubber Core Compound Evaluations | | | | | | |
|---|---|---|---|---|---|---|
| Material | 7 | 8 | 9 | 10 | 11 | 12 |
| BR 1207 | 95 | 90 | 85 | 80 | 75 | 50 |
| Millithane E-34 | 0 | 0 | 0 | 0 | 0 | 0 |
| Adiprene CM | 5 | 10 | 15 | 20 | 25 | 50 |
| SR 416D | 023.5 | 23.5 | 23.5 | 23.5 | 23.5 | 23.5 |
| Zinc Oxide | 5 | 5 | 5 | 5 | 5 | 5 |
| Barytes | 21 | 21 | 21 | 21 | 21 | 21 |
| EF(DCP)-70 | 1.56 | 1.56 | 1.56 | 1.56 | 1.56 | 1.56 |
| Wingstay L-HLS | 0.2 | 0.2 | 0.2 | 0.2 | 0.2 | 0.2 |
| Core Physical Properties | | | | | | |
| Size | 1.5044 | 1.5017 | 1.5031 | 1.5032 | 1.5029 | 1.5022 |
| PGA Compression | 60.5 | 57.8 | 60.2 | 59.2 | 53.5 | 27.8 |
| Weight | 34.52 | 34.68 | 34.89 | 35.28 | 35.19 | 36.42 |
| COR (100 ft/s) | 0.813 | 0.801 | 0.792 | 0.782 | 0.765 | 0.682 |
| COR (125 ft/s) | 0.774 | 0.762 | 0.751 | 0.74 | 0.727 | 0.643 |

Blend Example C-1 is a control or standard core which includes a high cis content polybutadiene rubber.
BR 1207 — Goodyear Polybutadiene (97% cis-content)
Millithane E-34 — TSE Industries Polyether Polyurethane Rubber
Adiprene CM — Uniroyal Polyether Polyurethane Rubber
SR 416D — Sartomer Zinc Diacrylate
ER(DCP)-70 — Dicumyl Peroxide (70% Active)
Wingstay L-HLS — Goodyear Antioxidant
Size — Diameter (inches)
PGA Compression — Measured using Atti Compression machine
COR (100 ft/s) — Ratio of outbound velocity/inbound velocity — 100 ft/s inbound velocity test setup
COR (125 ft/s) — Ratio of outbound velocity/inbound velocity — 125 f/s inbound velocity test setup Blend Examples 1–5 illustrate use of Millithane E-34 polyurethane rubber in the core compound, at levels of 5–25% of the total rubber content. The results of physical properties indicate a drop in core compression compared to comparative example C-1, which will result in improved feel of the golf ball. Resilience properties of the core compounds decrease somewhat, but are still sufficient for use in a premium golf ball.

Blend Example 6 illustrates use of Millithane E-34 polyurethane rubber in core compound, at a level of 50% of the total rubber content. At this level of polyurethane rubber, the core yields very poor cure properties (a compression of about 15) and resilience properties well below the level necessary for use in a premium golf ball.

Blend Examples 7–11 illustrate use of Adiprene CM polyurethane rubber in the core compound, at levels of 5–25% of the total rubber content. The results of physical properties indicate a drop in core compression compared to comparative example C-1, which also results in improved feel of the golf ball. Resilience properties of the core compounds decrease somewhat, but are still sufficient for use in a premium golf ball.

Blend Example 12 illustrates use of Adiprene CM polyurethane rubber in core compound, at a level of 50% of the total rubber content. At this level of Polyurethane rubber, the core yields very poor cure properties (a compression of about 27) and resilience properties well below the level necessary for use in a premium golf ball.

Overall, the results of Table 1 indicate that use of polyurethane rubber at levels of 5–25% of total rubber content results in a decrease in core compression, which will result in lower ball compression and better feel properties in the golf ball, while retaining sufficient resilience properties necessary for performance in a premium golf ball. We believe that polyurethane rubber can be used up to a level of 30% of total rubber content to obtain the desired compression and resilience properties.

Use of polyurethane rubber at level of 50% of total rubber content adversely affects cure properties of the compound, resulting in core compound which has compression and resilience properties well below those necessary for use in a premium golf ball.

Golf balls were made the core compounds identified in Table 2. Each of the golf balls included a cover formed from a blend of high acid ionomer resins. The specific ionomers used in the examples were Surlyn 8140, a 19% acid ionomer neutralized using Na ions, and Surlyn 6120, a 19% acid ionomer neutralized using Mg ions. A 50:50 blend ratio of these ionomers was used for the following examples.

TABLE 2

| | Examples | | | | |
|---|---|---|---|---|---|
| Material | C-2 | 13 | 14 | 15 | 16 |
| BR 1207 | 100 | 95 | 90 | 95 | 90 |
| Millithane E-34 | 0 | 5 | 10 | 0 | 0 |
| Adiprene CM | 0 | 0 | 0 | 5 | 10 |
| SR 416D | 23.5 | 22.4 | 21.4 | 22.4 | 21.4 |
| Zinc Oxide | 5 | 4.8 | 4.5 | 4.8 | 4.5 |
| Barytes | 21 | 20 | 19.1 | 20 | 19.1 |
| EF(DCP)-70 | 1.56 | 1.49 | 1.42 | 1.49 | 1.42 |
| Wingstay L-HLS | 0.2 | 0.19 | 0.18 | 0.19 | 0.18 |
| Core Physical Properties | | | | | |
| Size | 1.505 | 1.505 | 1.505 | 1.505 | 1.505 |
| PGA Compression | 62 | 52 | 44 | 55 | 49 |
| Weight | 34.4 | 34.18 | 34.11 | 34.58 | 34.54 |
| COR (100 ft/s) | 0.806 | 0.804 | 0.800 | 0.808 | 0.800 |
| COR (125 ft/s) | 0.766 | 0.760 | 0.758 | 0.761 | 0.753 |

TABLE 2-continued

| Material | Examples | | | | |
|---|---|---|---|---|---|
| | C-2 | 13 | 14 | 15 | 16 |
| **Ball Physical Properties** | | | | | |
| Size | 1.6800 | 1.6800 | 1.6799 | 1.6810 | 1.6810 |
| PGA Compression | 95 | 88 | 82 | 86 | 81 |
| Weight | 45 | 44.97 | 44.55 | 44.84 | 44.73 |
| Shore 'D' | 72 | 72 | 72 | 72 | 72 |
| COR (125 f/s) | 0.796 | 0.799 | 0.794 | 0.798 | 0.796 |
| COR (150 f/s) | 0.768 | 0.768 | 0.763 | 0.767 | 0.761 |
| COR (175 f/s) | 0.733 | 0.732 | 0.725 | 0.731 | 0.723 |
| Initial Velocity | 256.8 | 256.9 | 256.8 | 256.8 | 256.3 |
| **Ball Flight Properties (Hard Driver Test Conditions)** | | | | | |
| Carry Distance | 233.4 | 232.0 | 230.9 | 232.7 | 231.1 |
| Total Distance | 241.0 | 241.8 | 242.0 | 240.4 | 241.8 |
| Spin Rate | 3203 | 3180 | 3101 | 3121 | 3108 |
| **Ball Flight Properties (Soft Driver Test Conditions)** | | | | | |
| Carry Distance | 215.5 | 215.3 | 214.6 | 214.0 | 213.8 |
| Total Distance | 222.1 | 224.3 | 223.5 | 222.4 | 223.8 |
| Spin Rate | 3400 | 3294 | 3330 | 3285 | 3130 |

BR 1207 — Goodyear Polybutadiene (97% cis-content)
Millithane E-34 — TSE Industries Polyether Polyurethane Rubber
Adiprene CM — Uniroyal Polyether Polyurethane Rubber
SR 416D — Sartomer Zinc Diacrylate
EF(DCP)-70 — Dicumyl Peroxide (70% Active)
Wingstay L-HLS — Goodyear Antioxidant
Size — Diameter (inches)
PGA Compression — Measured using Atti Compression machine
COR (100 ft/s) — Ratio of outbound velocity/inbound velocity — 100 ft/s inbound velocity test setup
COR (125 ft/s) — Ratio of outbound velocity/inbound velocity — 125 ft/s inbound velocity test setup Blend Example C-2 is a control or standard core using high cis content polybutadiene rubber.

Blend Example 13 illustrates a core compound utilizing polyurethane rubber (Millithane E-34 polyether polyurethane rubber) at a level of 5% of the total rubber content of the compound. Testing of the properties of the core illustrates a significant decrease in the compression of the core (10 pts.), with a minimal decrease in the resilience properties compared to control core C-2. When the core of Example 13 is molded into a golf ball utilizing a high-acid cover blend, the resulting ball yielded a significant decrease in ball compression (about 7 pts.), which results in improved feel properties of the ball. Surprisingly, the ball yielded no drop in resilience properties compared to control sample C-2.

When tested for flight properties, the ball of Blend Example 13 yielded comparable distance properties to control ball C-2 when tested under hard driver conditions. When tested for distance properties using a slower swing speed (Soft Driver test), the ball of Example 13 surprisingly yields and increase in distance properties compared to control ball C-2. In both hard driver and soft driver testing, a decrease in spin rate, which is beneficial to the average golfer, is observed.

Blend Example 14 illustrates a compound utilizing polyurethane rubber (Millithane E-34 polyether polyurethane rubber) at a level of 10% of the total rubber content of the compound. Testing of the properties of the core illustrates a significant decrease in the compression of the core (18 pts.), with a minimal decrease in the resilience properties compared to control core C-2. When the core of example 14 is molded into a golf ball utilizing a high-acid cover blend, the resulting ball also yielded a significant decrease in ball compression (about 13 pts.), which results in improved feel properties of the ball. Despite the significant drop in compression, the ball of Example 14 did not exhibit a significant drop in initial velocity or resilience properties compared to control sample C-2.

When tested for flight properties, the ball of Example 14 yielded comparable distance properties to control ball C-2 when tested under hard driver conditions. When tested for distance properties using a slower swing speed (Soft Driver test), the ball of Example 14 surprisingly yields an increase in distance properties compared to control ball C-2. In both hard driver and soft driver testing, a decrease in spin rate, which is beneficial to the average golfer, is observed.

Blend Example 15 illustrates a compound utilizing polyurethane rubber (Adiprene CM polyether polyurethane rubber) at a level of 5% of the total rubber content of the compound. Testing of the properties of the core illustrates a significant decrease in the compression of the core (7 pts.), while yielding comparable resilience properties to control core C-2. When the core of Example 15 is molded into a golf ball utilizing a high-acid cover blend, the resulting ball also yielded a significant decrease in ball compression (about 9 pts.), which results in improved feel properties of the ball. Despite the significant drop in compression, the ball of Example 15 did not exhibit a significant drop in initial velocity or resilience properties compared to control sample C-2.

When tested for flight properties, the ball of Example 15 yielded comparable distance properties to control ball C-2 when tested under hard driver conditions. When tested for distance properties using a slower swing speed (Soft Driver test), the ball of Example 15 yields comparable distance properties compared to control ball C-2. In both hard driver and soft driver testing, a decrease in spin rate, which is beneficial to the average golfer, is observed.

Blend Example 16 illustrates compound utilizing polyurethane rubber (Adiprene CM polyether polyurethane rubber) at a level of 10% of the total rubber content of the compound. Testing of the properties of the core illustrates a significant decrease in the compression of the core (13 pts.), with a minimal decrease in the resilience properties compared to control core C-2. When the core of Example 16 is molded into a golf ball utilizing a high-acid cover blend, the resulting ball also yielded a significant decrease in ball compression (about 14 pts.), which results in improved feel properties of the ball. Despite the significant drop in compression, the ball of Example 16 did not exhibit a significant drop in initial velocity or resilience properties compared to control sample C-2.

When tested for flight properties, the ball of Example 16 yielded comparable distance properties to control ball C-2 when tested under hard driver conditions. When tested for distance properties using a slower swing speed (Soft Driver test), the ball of Example 16 surprisingly yields an increase in distance properties compared to control ball C-2. In both hard driver and soft driver testing, a decrease in spin rate, which is beneficial to the average golfer, is observed.

Overall, balls molded utilizing cores of this invention result in significantly improved feel properties as indicated by the significant decrease in compression properties illustrated by Examples 13–16. All balls of Examples 13–16 yield comparable resilience and initial velocity properties to control example C-2.

Flight distance properties of balls of Examples 13–16 are comparable to those of control ball C-2 when tested under "Hard Driver" test setup. Surprisingly, when tested using a slower swing speed (Soft Driver test setup), the balls of Examples 13–16 yield improved flight distance performance compared to control ball C-2.

Under both "Hard Driver" and "Soft Driver" test conditions, a decrease in driver spin rate is observed.

Generally, the balls of the invention (Examples 13–16) yield improved feel properties and improved performance properties for the average golfer (lower spin rate to reduce hooks/slices, and longer flight distance performance at slower swing speed).

Additional cores were made in accordance with Table 3.

TABLE 3

| | Examples | |
|---|---|---|
| | C3 | 17 |
| Material | | |
| Budene BR-1207 | 100 | 95 |
| Adiprene FM | 0 | 5 |
| Zinc Diacrylate | 22.25 | 22.25 |
| Zinc Oxide | 5 | 5 |
| Barytes | 26.5 | 26.5 |
| EF(DCP)-70 | 1.54 | 1.54 |
| KR(TTS)-70 | 0.4 | 0.4 |
| Wingstay L-HLS | 0.2 | 0.2 |
| Regrind | 5.86 | 5.86 |
| Core Physical Properties | | |
| Size | 1.5038" | 1.4993" |
| PGA Compression | 52.2 | 43.1 |
| Weight | 34.73 | 34.23 |
| C.O.R. (100 f/s) | 0.806 | 0.806 |
| C.O.R. (125 f/s) | 0.764 | 0.762 |

KR(TTS)-70 - Titanate Coupling Agent (Kenrich Petrochemical)

Blend Example C-3 is a control or standard core using high cis-polybutadiene rubber.

Blend Example 17 illustrates a core compound utilizing polyurethane rubber (Adiprene FM) at a level of 5% of the total rubber content of the compound. Testing of the properties of the core illustrate a significant decrease in core compression, with no loss in resilient properties. These results are consistent with previous examples.

FIGS. 2A through 4B are scanning probe microscope images of the Control C-3 and example 17 invention. Scanning probe microscopy is a known conventional testing procedure which detects mechanical property contrast (brighter areas are harder darker areas are softer). FIG. 5 illustrates the operating principles of scanning probe microscopy. The scanning probe microscope testing was performed by Goodyear.

Figure 2A:
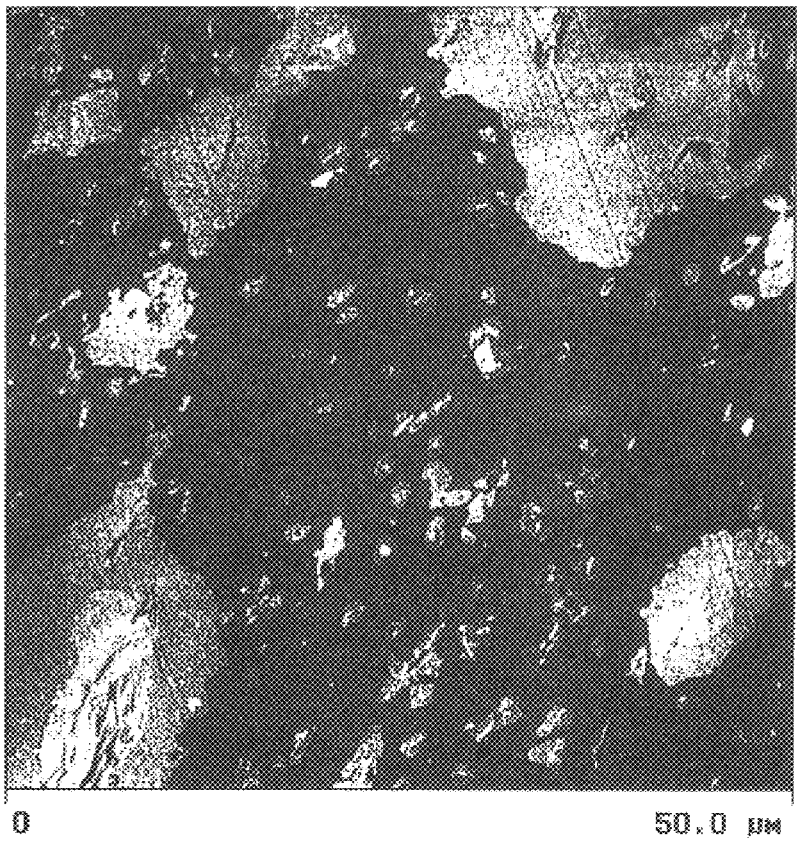
FIGS. 2A, 3A, and 4A are scanning probe microscope images of Control C-3 of Table 3.

FIG. 2A is a scanning probe microscope image (50 $\mu$m) of the control C-3. The image shows ZDA needles (dark with a bright halo) dispersed throughout the soft polybutadiene matrix. Each ZDA particle is surrounded by a large region of intermediate hardness, which is most likely polybutadiene with higher crosslink density than the matrix. This indicates that the crosslink density throughout the polybutadiene is not uniform.

Figure 2B:
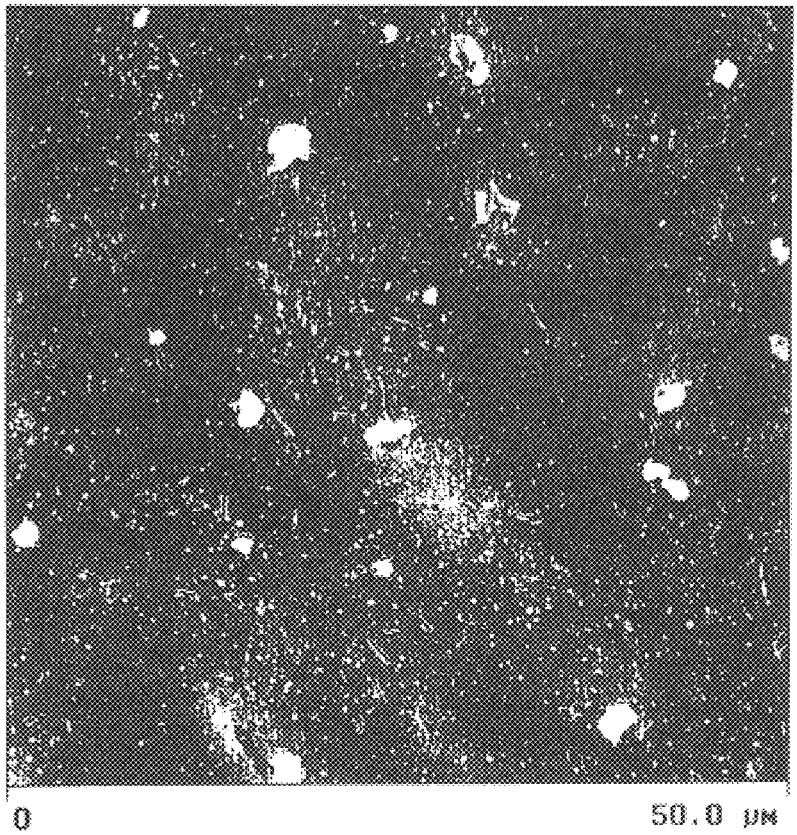
FIGS. 2B, 3B, and 4B are scanning probe microscope images of Example 17 of Table 3.

FIG. 2B is a scanning probe microscope image (50 $\mu$m) of the Example 17. In this compound, the more uniform contrast is evidence of uniform crosslink density for the polybutadiene. The ZDA needles are present similar to the control, but no regions of intermediate hardness around the particles are found. Irregularly shaped bright white objects (1–5 $\mu$m in size) are seen dispersed throughout the compound. Since these objects are not found in the control, they are assumed to be related to the urethane component. The speckled contrast in the matrix regions around the ZDA is also not seen in the control, and also is related to the urethane component.

Figure 3A:
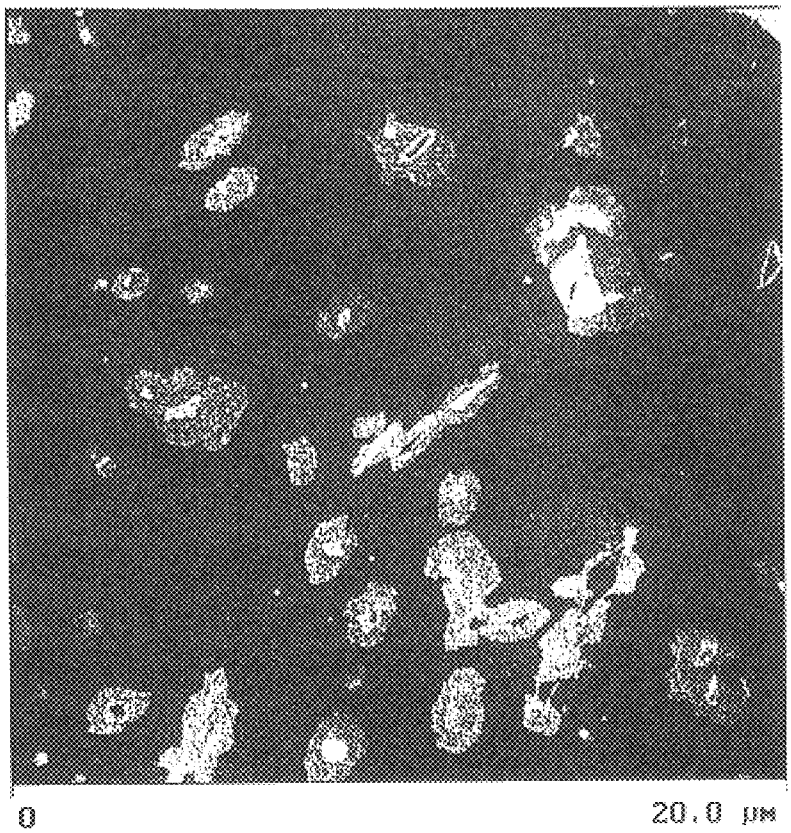

FIG. 3A is a scanning probe microscope image (20 $\mu$m in size) of the Control C-3. The ZDA particles with surrounding regions of intermediate hardness are easily seen. Uniformity of the polybutadiene itself is in contrast with the Example 17.

Figure 3B:
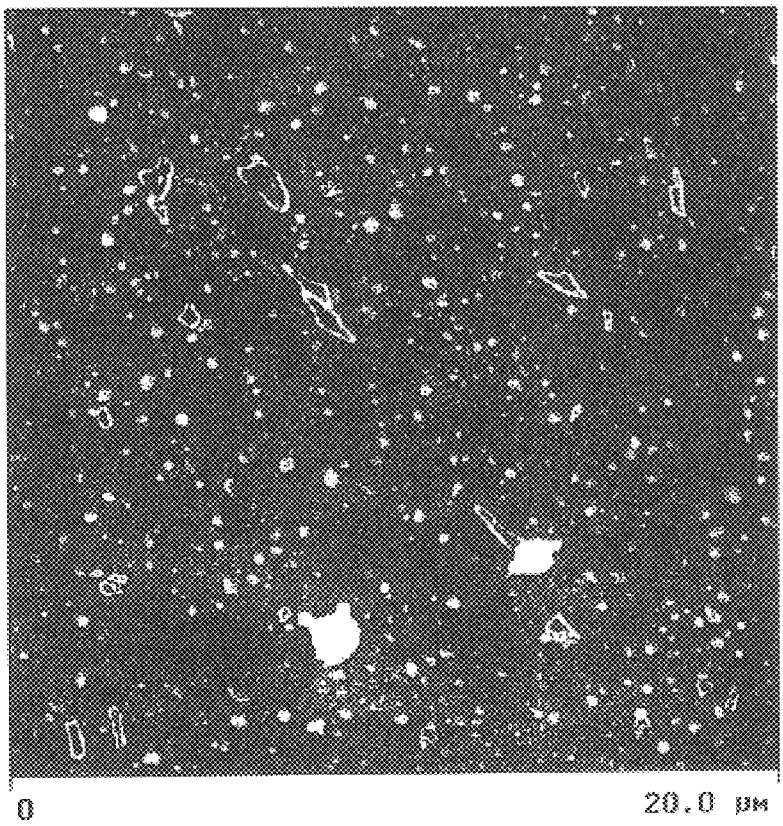

FIG. 3B is a scanning probe microscope image (20 $\mu$m) of Example 17. It is apparent that the speckled contrast is due to small, spherical particles, slightly harder than the polybutadiene, dispersed throughout the polybutadiene matrix. These small particles are related to the urethane component. Since they consume a larger volume fraction of the image than would be expected by the compound formulation, this probably indicates an interaction or entanglement with the polybutadiene.

Figure 4A:
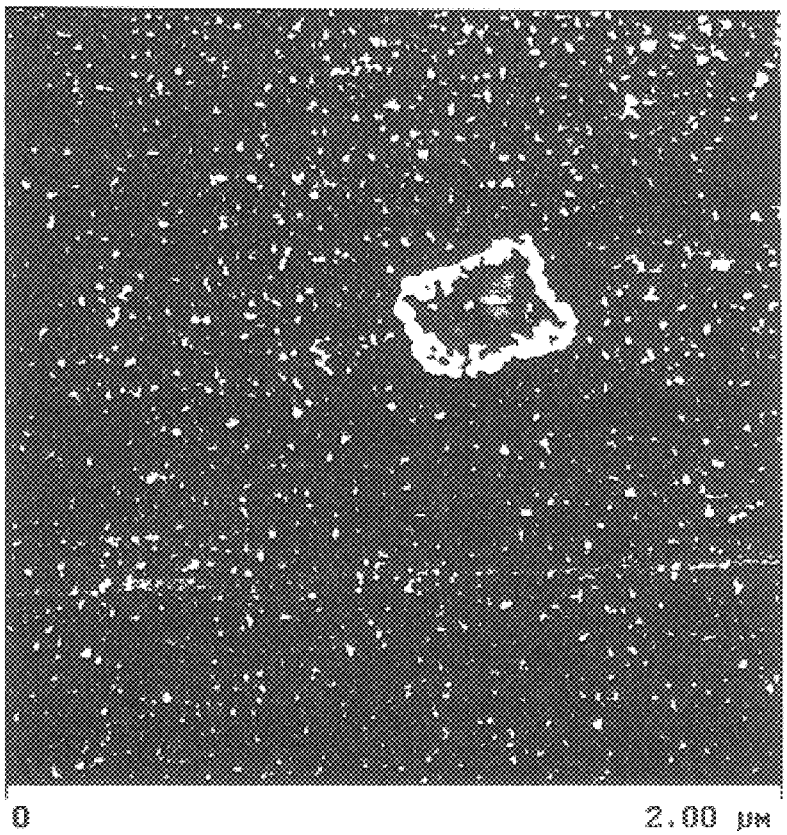
Figure 5:
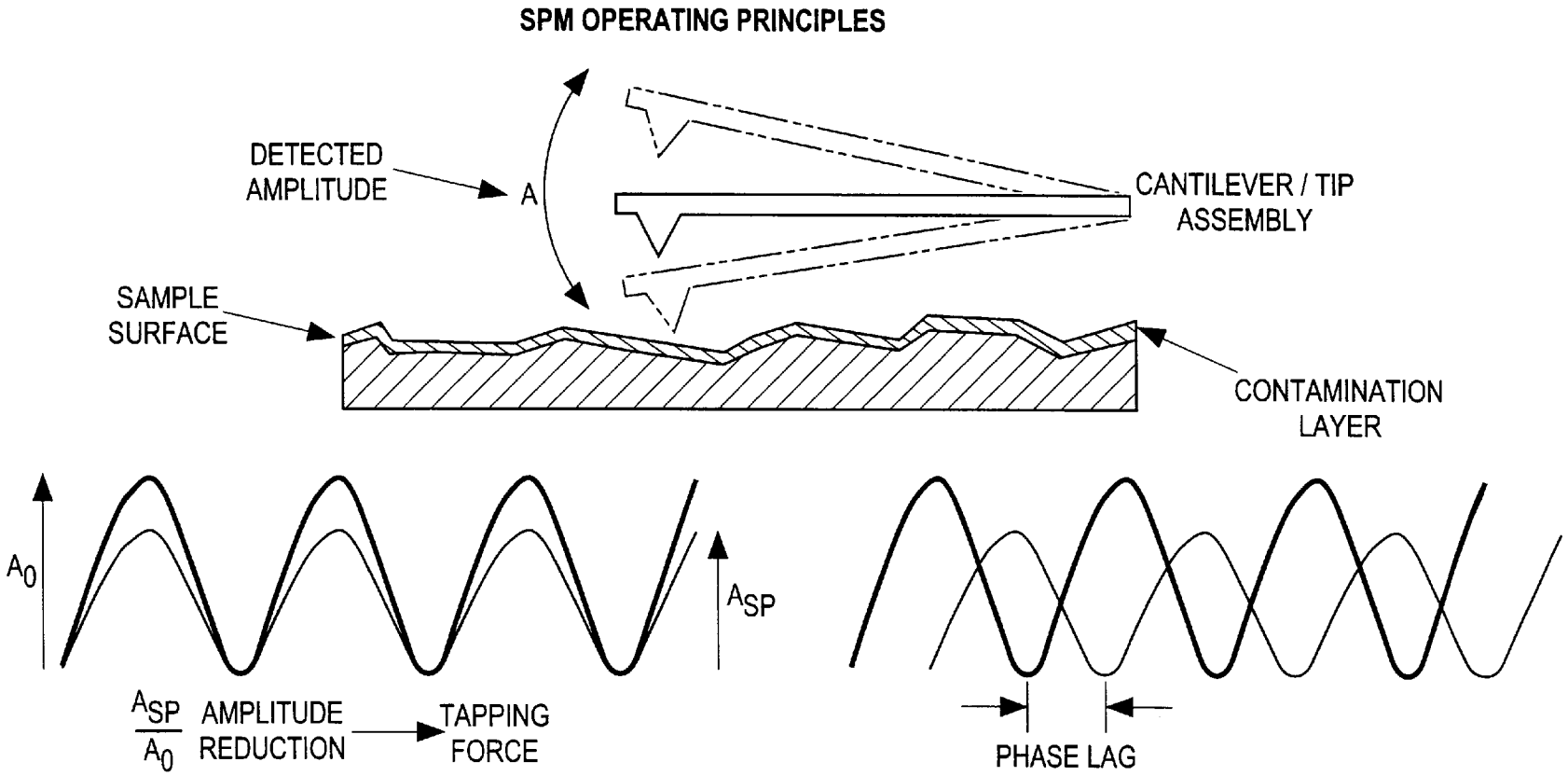
FIG. 5 illustrates the operating principles of a scanning probe microscope.

FIG. 4A is a scanning probe microscope image (2 $\mu$m) of the Control C-3. A single ZDA particle has been isolated. The tightly bound network attached to the surface of the ZDA particles appears as a bright white halo.

Figure 4B:
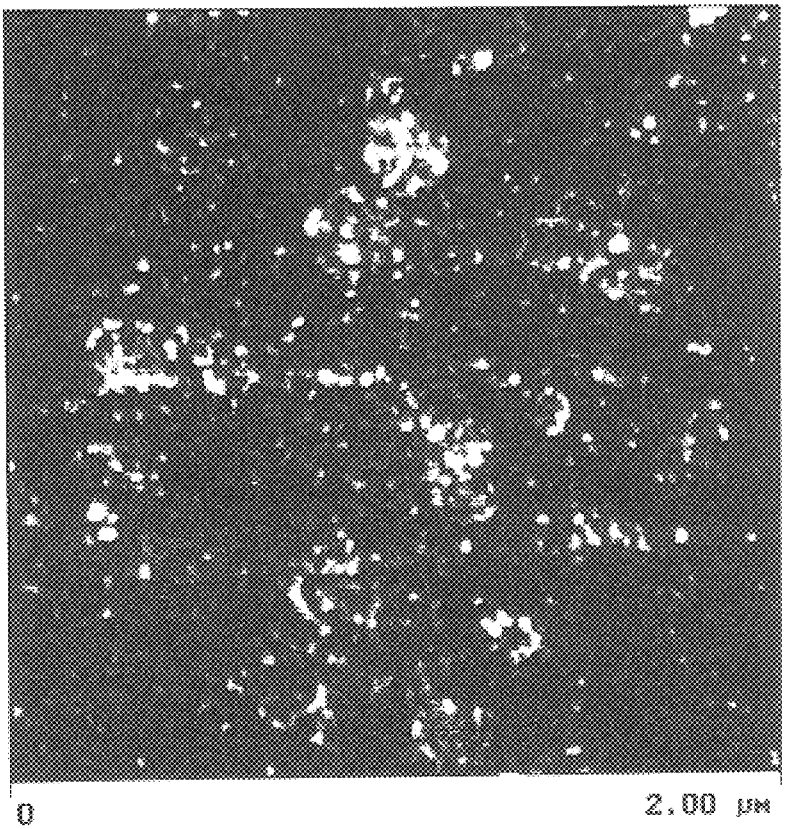

FIG. 4B is a scanning probe microscope image (2 $\mu$m) of the Example 17. No ZDA is observed in this image. It is difficult to distinguish the urethane from the polybutadiene at this magnification, which is an indication of interaction between the two materials.

Overall, the Control C-3 shows large domains of different "hardness" or "crosslink density", which are not present in Example 17 of the invention. The Example 17 shows a much more uniform crosslink density distribution than the control C-3. This is indicative of an interactive relationship between the urethane and the polybutadiene.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A golf ball comprising a core and a cover the core comprising:

100 phr rubber, the rubber consisting of 70 to 95% by weight of a high cis content polybutadiene and
5 to 30% by weight of a polyurethane rubber,
15 to 40 phr of crosslinking agent,
0.5 to 5 phr of a crosslinking initiator, and
0 to 10 phr of a metal oxide activator.

2. The golf ball of claim 1 in which the cover comprises ionomer resin.

3. The golf ball of claim 1 in which the polyurethane rubber is a polyether based polyurethane rubber.

4. The golf ball of claim 1 in which the polyurethane rubber is a polyester based polyurethane rubber.

5. The golf ball of claim 1 in which the polyurethane rubber is a mixture of polyether and polyester based polyurethane rubber.

6. The golf ball of claim 1 in which the crosslinking agent is an acrylate of a zinc salt.

7. The golf ball of claim 6 in which the acrylate of zinc salt is zinc diacrylate.

8. The golf ball of claim 1 in which the crosslinking initiator is an organic peroxide.

9. The golf ball of claim 1 in which the crosslinking initiator is dicumyl peroxide.

10. The golf ball of claim 1 in which the metal oxide activator is zinc oxide.

11. The golf ball of claim 1 in which the core includes up to 1 phr of a titanate coupling agent.

* * * * *